US010975873B2

(12) United States Patent
Seifried

(10) Patent No.: US 10,975,873 B2
(45) Date of Patent: Apr. 13, 2021

(54) AXIAL VENTILATOR

(71) Applicant: Ziehl-Abegg SE, Künzelsau (DE)

(72) Inventor: Daniel Seifried, Schwäbisch Hall (DE)

(73) Assignee: Ziehl-Abegg SE, Kunzelsau (DE)

( * ) Notice: Subject to any disclaimer, the term of this patent is extended or adjusted under 35 U.S.C. 154(b) by 352 days.

(21) Appl. No.: 15/537,199

(22) PCT Filed: Dec. 3, 2015

(86) PCT No.: PCT/DE2015/200524
§ 371 (c)(1),
(2) Date: Jun. 16, 2017

(87) PCT Pub. No.: WO2016/095915
PCT Pub. Date: Jun. 23, 2016

(65) Prior Publication Data

US 2017/0350402 A1 Dec. 7, 2017

(30) Foreign Application Priority Data

Dec. 17, 2014 (DE) ..... 10 2014 226 288.7

(51) Int. Cl.
*F04D 19/00* (2006.01)
*F04D 29/36* (2006.01)
*F04D 29/64* (2006.01)

(52) U.S. Cl.
CPC ..... *F04D 19/002* (2013.01); *F04D 29/36* (2013.01); *F04D 29/644* (2013.01)

(58) Field of Classification Search
CPC ..... F04D 29/34; F04D 29/36; F04D 19/002; F04D 29/644
USPC ..... 416/61, 207, 208, 214 R, 219 R, 220 R, 416/220 A; 415/118
See application file for complete search history.

(56) References Cited

U.S. PATENT DOCUMENTS 2,918,977 A 12/1959 Fedan et al.
3,073,395 A 1/1963 Duncan
4,150,921 A * 4/1979 Wennberg ..... B63H 3/12 416/207

(Continued)

FOREIGN PATENT DOCUMENTS

GB 713 855 A 8/1954
GB 1466863 A * 3/1977 ..... F04D 29/36
WO WO-2014117288 A1 * 8/2014 ..... F04D 17/025

*Primary Examiner* — Michael Lebentritt
*Assistant Examiner* — Jesse M Prager
(74) *Attorney, Agent, or Firm* — McDonnell Boehnen Hulbert & Berghoff LLP

(57) ABSTRACT

The invention relates to an axial ventilator comprising an external or an internal rotor motor that has a rotor (1), at least two blades (4) with end-side connection regions (6) being connected form- and force-fittingly to said rotor (1) and this connection being achieved by bracing said connection regions (6) using a clamping ring (2). The invention is characterised in that said clamping ring (2) comprises recesses (5) that correspond to the number of blades (4) and form, together with one retainer piece (7) in each case, receiving portions (8) for the connection region (6) of the blades (4), said retainer piece (7) being supported against the rotor (1) and the clamping ring (2) being connected, with the inclusion of the connection region (6) of the blades (4), to said rotor (1), preferably to a flange (3) formed on the rotor (1) or to a hub (9), etc.

10 Claims, 24 Drawing Sheets

(56) References Cited

U.S. PATENT DOCUMENTS

| | | | | |
|---|---|---|---|---|
| 4,600,362 | A * | 7/1986 | Vostermans | F04D 29/34<br>416/208 |
| 5,520,515 | A | 5/1996 | Bailey et al. | |
| 6,250,886 | B1 * | 6/2001 | Immell | F04D 29/388<br>416/214 R |
| 2016/0319836 | A1 * | 11/2016 | Widell | F04D 29/36 |

* cited by examiner

AXIAL VENTILATOR

This application is a U.S. National Phase Application pursuant to 35 U.S.C. § 371 of International Application No. PCT/DE2015/200524 filed Dec. 3, 2015, which claims priority to German Patent Application No. 10 2014 226 288.7 filed Dec. 17, 2014. The entire disclosure contents of these applications are herewith incorporated by reference into the present application.

The invention relates to an axial ventilator having an external or internal rotor motor comprising a rotor, wherein at least two blades with end-side connection regions are connected to the rotor in a form- and force-fitting manner, and wherein the connection is obtained by tightening the connection region thereto by means of a tension ring.

This fundamentally pertains to ventilators driven by an external rotor motor or an internal rotor motor. In accordance with the concrete configuration, the blades are securely connected to the rotor on the external surface thereof, or at the front to the hub of the internal rotor. The connection of the blades normally takes place in the prior art via two tension ring halves or via a tension ring and a counter piece permanently connected to the rotor, in order to connect the individual blades to the rotor in a form- and force-fitting manner. With a variation on the number of blades, e.g. three blades, five blades, or seven blades, different tension ring halves, or different tension rings, as well as the counter piece on the rotor, are needed. Due to the very different parts, this is complicated in terms of production effort and storage. Reference is made only by way of example to EP 0 769 095 B1, EP 0 121 061 B1 and EP 1 783 375 A1 regarding the prior art.

In the prior art, it is disadvantageous that depending on the number of blades, a concrete connection technology is necessary, resulting in a connection concept that is inflexible. In contrast, it is necessary to provide different components for connecting the blades with ventilators having different numbers of blades, up to the specific securing thereof to the rotor.

The present invention therefore addresses the object of creating a flexible connection concept for the blades of axial ventilators, according to which only a few different connection components are required with different numbers of blades. The connection concept according to the invention should have a maximum flexibility in terms of the installation and with respect to the parts that are to be produced and stocked.

The above object is achieved by the features of Claim 1. Accordingly, the generic axial ventilator is characterized in that the tension ring has recesses corresponding to the number of blades, which form receivers, together with a retaining piece in each case, for the connection regions of the blades, wherein the retaining pieces bear on the rotor, and the tension ring is connected to the rotor such that it encloses the connection regions of the blades, preferably being connected to flange or hub, etc. formed on the rotor.

It has been acknowledged according to the invention that axial ventilators having a different number of blades need only be equipped with a specific assembly component, specifically a tension ring having a number of recesses corresponding to the number of blades that are to be attached, which serve at least in part to receive the blades. If the axial ventilator is to have a total of three blades, then a tension ring having three such recesses is to be used, into which the blades fit at their end-side connection regions. Each of the recesses of the tension ring interacts with a retaining piece, which is to be regarded as a counter piece.

The recesses in the tension ring, together with the retaining piece, collectively form a two-part receiver for the connection regions of the respective blades.

The flexibility of the connection concept according to the invention is derived from the interaction of a tension ring with a retaining piece for each recess, such that a number of receivers are obtained for the connection regions of the blades. corresponding to the number of recesses, when retaining pieces are added. Further specific components, aside from the tension ring, are not necessary.

The retaining piece is designed in terms of its form or contour, such that it bears in an ideal manner against the rotor, or against a component of the rotor, respectively. The tension ring is connected to the rotor, enclosing the connection region of the respective blade, such that the connection region of the respective blade is tightly retained inside the recess. The tension ring is preferably connected to a flange, hub, etc. formed on the rotor, depending on whether the drive is an external rotor motor or an internal rotor motor. Regardless of the concrete configuration, it is important that the tension ring, together with the retaining piece, forms a receiver for the connection region of the blade, and tightly retains the connection region of the blade inside the receiver in that the tension ring is securely screwed to the rotor. In this manner, a secure connection is obtained.

It should be noted at this point that the flexibility of the connection concept according to the invention is based on the fact that only one single specific component is necessary, specifically a tension ring configured to the number of blades. Regardless of the number of blades, each recess in the tension ring acts together with a uniform retaining piece, such that this retaining piece can be readily stocked in a single embodiment.

The retaining piece and the respective recess in the tension ring can be coordinated to one another such that the retaining piece is at least slightly inserted into the recess of the tension ring, by means of which the blade can be attached in a preliminary manner to the tension ring. The retaining piece and the recess of the tension ring collectively form the receiver for the connection region of the blade, wherein this receiver can be designed such that it is substantially symmetrical over a rotational axis, corresponding to the design of the connection region of the blade.

Advantageously, measures for defining the blade angle are provided. For this, it is conceivable that the receiver has at least one hole in the region of the retaining piece and/or in the region of the recess in the tension ring, into which a positioning lug on the connection region of the blade fits, and in this manner defines the blade angle.

In the framework of greater flexibility, is it of great advantage when the receiver has at least one hole in the region of the retaining piece and/or in the region of the recess in the tension ring, in which a positioning lug of an indexing piece, which is permanently dedicated to the blade, fits, such that it can be replaced, and/or reversed or turned over. These measures also make it possible to define the blade angle, specifically in accordance with the design or configuration of the positioning lug on the indexing piece.

The use of a special indexing piece is accompanied by the disadvantage of requiring another component, but it has tremendous advantages regarding flexibility, in that it is possible to define both the blade angle as well as the conveyance direction using the indexing piece, specifically due to the position of the blade inside the receiver dictated by the indexing piece.

The indexing piece is preferably a component that can be attached to the lower end of the connection region of the blade, or can be inserted there, and optionally snapped in place, such that a type of encoding with respect to the position of the blade in the receiver can be implemented by the indexing piece. In any case, the indexing piece supplements the connection region of the blade, and creates a defined positioning of the connection region inside the receiver, and thus defines the position of the blade as a whole.

It is furthermore advantageous when the indexing piece has a specific color corresponding to the blade angle defined by the positioning lug, which can be recognized from the outside, specifically the front, through a hole formed in the tension ring. As a result, it is possible to determine the blade angle with which the ventilator is running at any time. It is also possible to check whether all of the blades of the ventilator are installed with the same blade angle.

As specified above, it is possible to define the blade angle with the indexing piece, or to later change the blade angle, specifically by replacing the indexing piece. Depending on the configuration and concrete installation of the indexing piece, it defines not only the blade angle, but also the direction of conveyance. Consequently, a single indexing piece can define two conveyance directions and two blade angles by reversing it. This too provides a maximum of flexibility.

It is conceivable in the framework of another variation, that a positioning lug is dedicated to the retaining piece and/or the recess inside the receiver formed collectively for the connection region of the blade. This positioning lug engages in a recess in the connection region of the blade, by means of which the blade angle and potentially the conveyance direction are defined. Here as well, at least the blade angle is set in a defined manner, but it exhibits less flexibility than the variation having the indexing piece.

The tension ring is connected to the rotor in accordance with which drive—external rotor or internal rotor—is used, in particular with a flange on the external rotor motor or a hub in the front region of the internal rotor motor. Other arbitrary attachment possibilities are conceivable, and comprised in the teachings according to the invention.

Depending on protrusions on the rotor, the tension ring can be screwed to the rotor from either the tension ring side, i.e. from the front, or from the flange side, i.e. from the back. When screwed on from the front, it is possible to screw the tension ring to the rotor through corresponding screw holes in the tension ring, using typical screws. Alternatively, it is conceivable to screw the tension ring on from the flange side, i.e. form the back, wherein it is possible thereby to achieve the back-side screwing by means of plastic direct screw couplings.

With regard to the materials used, it is advantageous to coordinate them to one another. The blade, the tension ring, the retaining element, and potentially the indexing piece can be made of plastic in a plastic injection molding process, or they can be made of aluminum in an aluminum pressure die casting process. It is also conceivable to produce the parts exposed to wear or unintended deformation from a harder material, i.e. a harder plastic or a harder aluminum alloy.

There are now various possibilities to embody and develop the teachings of the present invention in an advantageous manner. For this, reference is made on one hand to the Claims subordinate to Claim 1, and on the other hand, to the following explanations of preferred exemplary embodiments of the invention based on the drawings. In conjunction with the explanations of the preferred exemplary embodiments of the invention based on the drawings, preferred designs and developments of the teachings shall also be explained in general. In the drawings, FIGS. 1, 2 and 3 show, in a schematic view, exemplary embodiments of an axial ventilator with an external rotor motor having three, five and seven blades, FIG. 4 shows the subject matter of FIG. 3 in an exploded view, with the substantial components of the invention, FIGS. 5, 6, and 7 show, in a schematic view, exemplary embodiments of an axial ventilator having three, five and seven blades, with an internal rotor motor, FIG. 8 shows the subject matter of FIG. 7 in an exploded view, with the substantial components of the invention, FIG. 9 shows, in a schematic view, a tension ring for connecting three blades from the front, FIG. 10 shows, in a schematic view, the subject matter of FIG. 9, from the back, FIG. 11 shows, in a schematic view, a tension ring for connecting five blades from the front, FIG. 12 shows, in a schematic view, the subject matter of FIG. 11, from the back, FIG. 13 shows, in a schematic view, a tension ring for connection seven blades from the front, FIG. 14 shows, in a schematic view, the subject matter of FIG. 13 from the back, FIG. 15 shows, in a schematic view, an exemplary embodiment of a retaining piece, FIG. 16 shows, in a cutaway and enlarged view, a cut through the tension ring and the blade, including illustrations of the retaining element and the inserted indexing piece, FIG. 17 shows, in a cutaway and enlarged view, an alternative configuration of the assembly according to FIG. 16, wherein the retaining element assumes the task of the indexing piece according to FIG. 16 with a positioning lug, FIG. 18 shows, in a schematic view, the angle variation by means of the indexing piece, angle +4°, in the one conveyance direction, FIG. 19 shows, in a schematic view, the angle variation by means of the indexing piece, angle −4°, in the one conveyance direction, FIG. 20 shows, in a schematic view, the angle variation by means of the indexing piece, angle +4°, in the other conveyance direction, FIG. 21 shows, in a schematic view, the angle variation by means of the indexing piece, angle −4°, in the other conveyance direction, FIGS. 22 and 23 show, in respective schematic views, an indexing piece for the angles +4° and −4° for both conveyance directions, and FIG. 24 shows, in a schematic view, an exemplary embodiment of a blade according to the invention having a connection region at the bottom, which can be supplemented by an indexing piece corresponding to FIGS. 22 and 23.

FIGS. 1, 2, and 3 show exemplary embodiments of an axial ventilator according to the invention, having an external rotor motor. Accordingly, the rotor 1 is disposed externally, and the blades (three blades according to FIG. 1, five blades according to FIG. 2, and seven blades according to FIG. 3) are connected to a flange 3 of the rotor 1 via a tension ring 2. The conveyance direction and the blade angles are defined according to the orientation of the blades 4, or the indexing piece 12.

It can be discerned in FIGS. 1, 2, and 3 that different tension rings 2 can be used, corresponding to the number of blades 4, having recesses 5 corresponding to the number of blades 4, which receive the connection regions 6 of the blades 4.

It can further be discerned in FIGS. 1, 2, and 3 that passages 2*a* in the manner of front-side screw holes are provided in the tension ring 2, in order to obtain, specifically, the assembly and tightening "from the front."

FIG. 4 shows an exploded view of substantial components of the subject matter in FIG. 3, wherein only one blade 4 is depicted therein.

According to the illustration in FIG. 4, the rotor 1 is shown with the flange 3, to which the respective tension ring 2 is screwed. In order to be able to screw different tension rings 2, corresponding to the number of blades 4, to the flange 3, the flange is provided with a hole pattern 2*b*, specifically for screwing on different tension rings 2, forming passages 2*a*, or screw holes. The hole pattern 2*b* is thus configured for screwing on all of the tension rings 2 in question, corresponding to the screw holes therein.

The tension ring 2 is provided with a total of seven recesses, each of which interacts with an identical retaining piece 7. The connection region 6 of the blade 4 is encompassed in the recess 5 by the material of the tension ring 2 and the retaining piece 7, and is located in a more or less closed receiver 8 through the interaction of the tension ring 2 and the retaining piece 7 (see FIGS. 16, 17), wherein the entire assembly, i.e. when the blade 4 has been inserted, is screwed to the flange 3 of the rotor 1 via the tension ring 2, and is tightened in place thereby. As a result, a form- and force-fitting connection is obtained.

FIGS. 5, 6, and 7 show further exemplary embodiments of axial ventilators according to the invention corresponding to FIGS. 1, 2, and 3, but with an internal rotor motor. The rotor 1 runs internally, and the tension ring 2 is connected to the hub 9 of the rotor 1. The blades are defined in accordance with the explanations for FIGS. 1 to 3. In this regard, the same explanations of the variations having the external rotor motor also apply.

FIG. 8 shows the subject matter of FIG. 7 in an exploded view, wherein here too, the tension ring 2 and its recesses 5 interact with identical retaining pieces 7. The recesses 5 form, together with the retaining pieces 7, receivers 8 for the connecting regions 6 of the blades 4. The screwing on of the tension ring 2 takes places here from the front, through the passages 2*a*, wherein the tension ring 2 is screwed to the hub 9 of the rotor 1.

According to the explanations of FIG. 4, the hub 9 is provided with a hole pattern 2*b*, which is configured such that all of the tension rings 2 in question, in accordance with the passages 2*a*, or screw holes, can be screwed to the hub 9 of the rotor 1.

Figure 1:
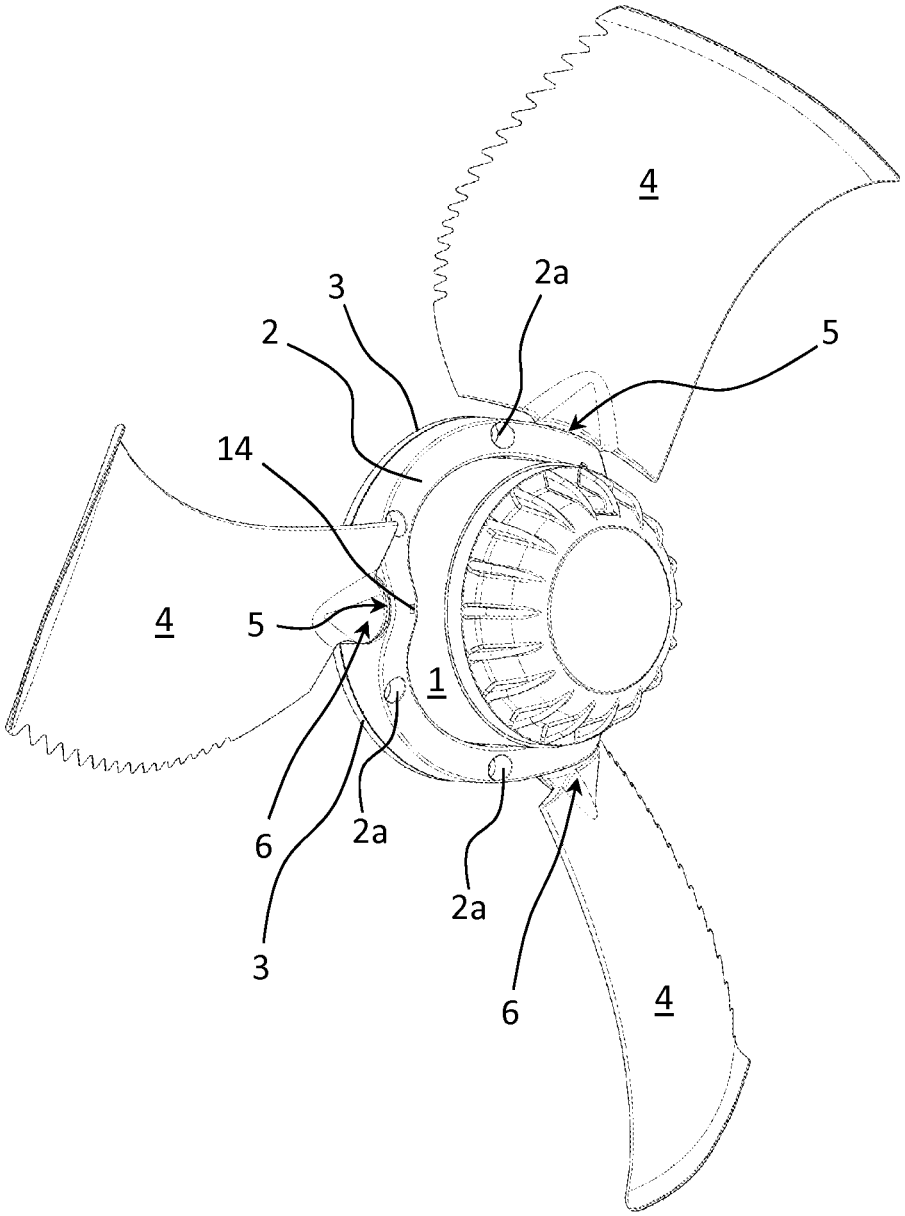
Figure 2:
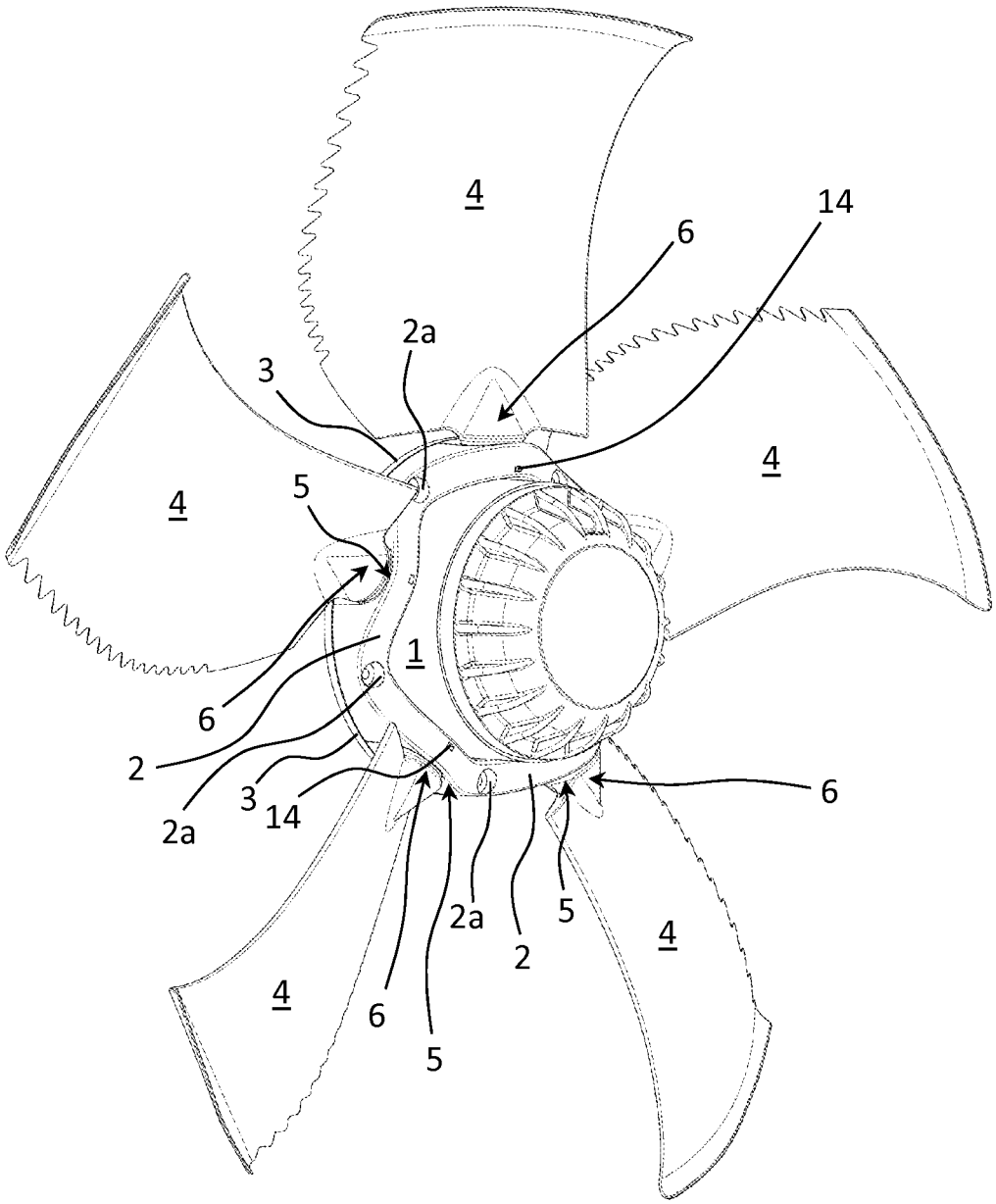
Figure 3:
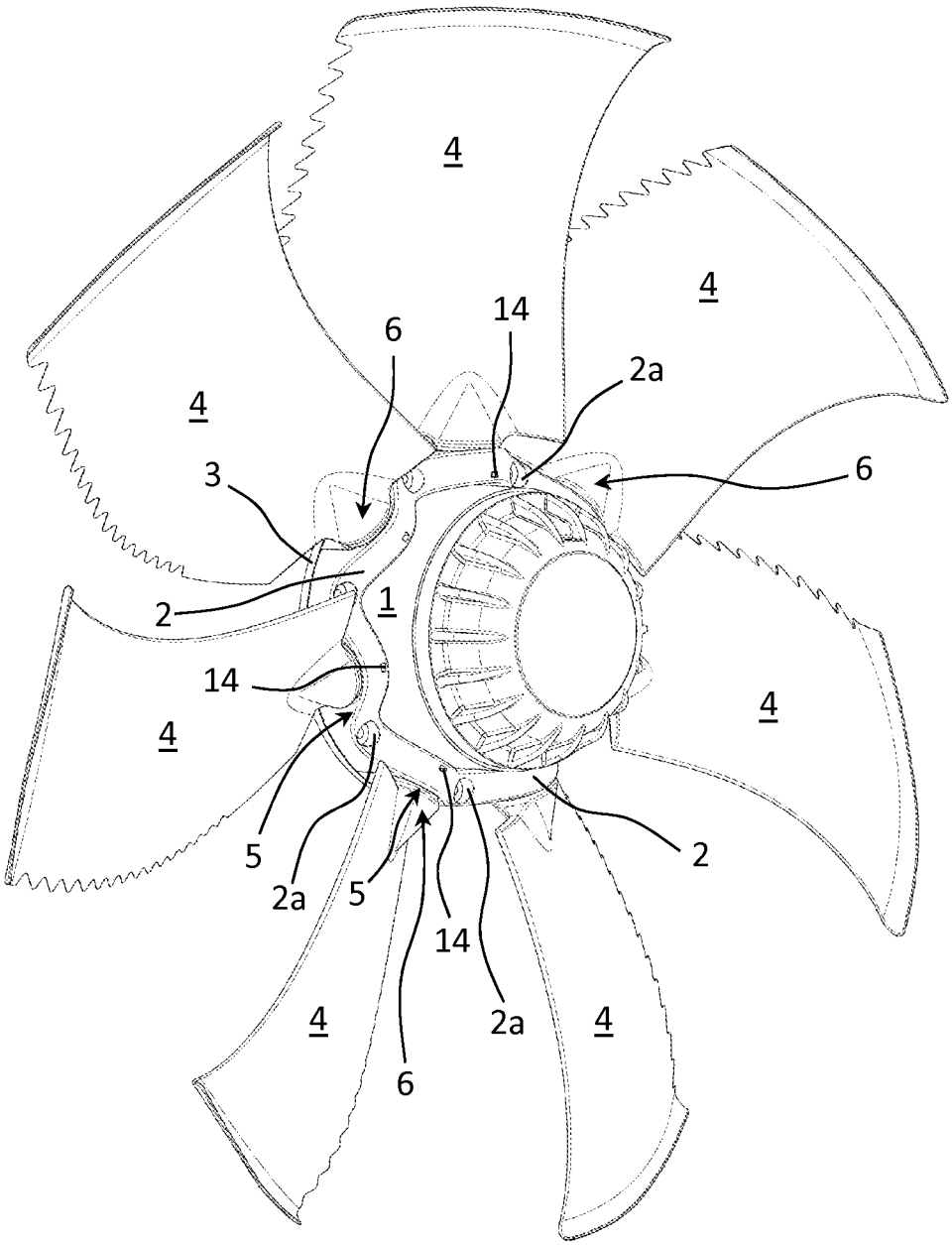
Figure 4:
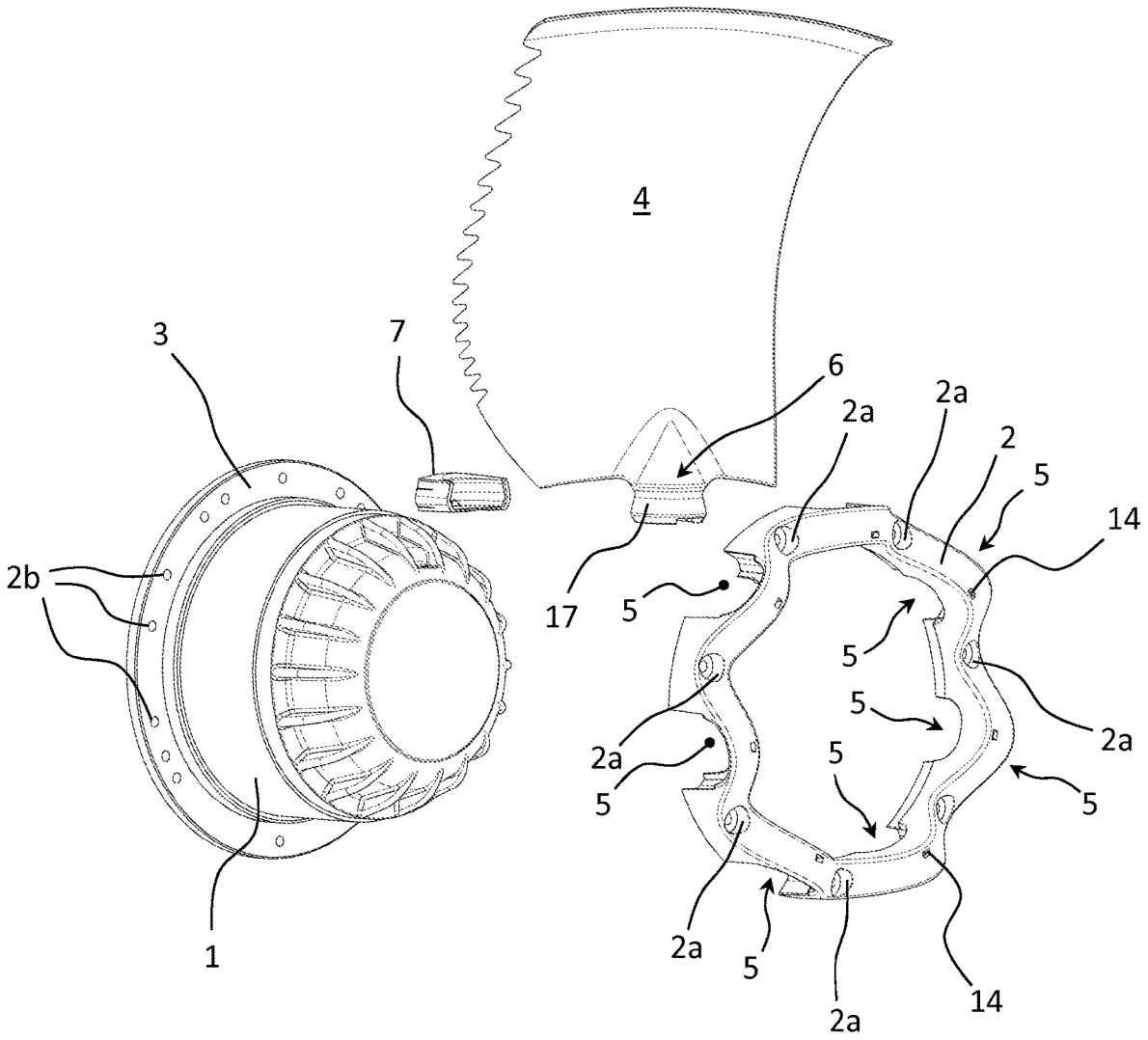
Figure 5:
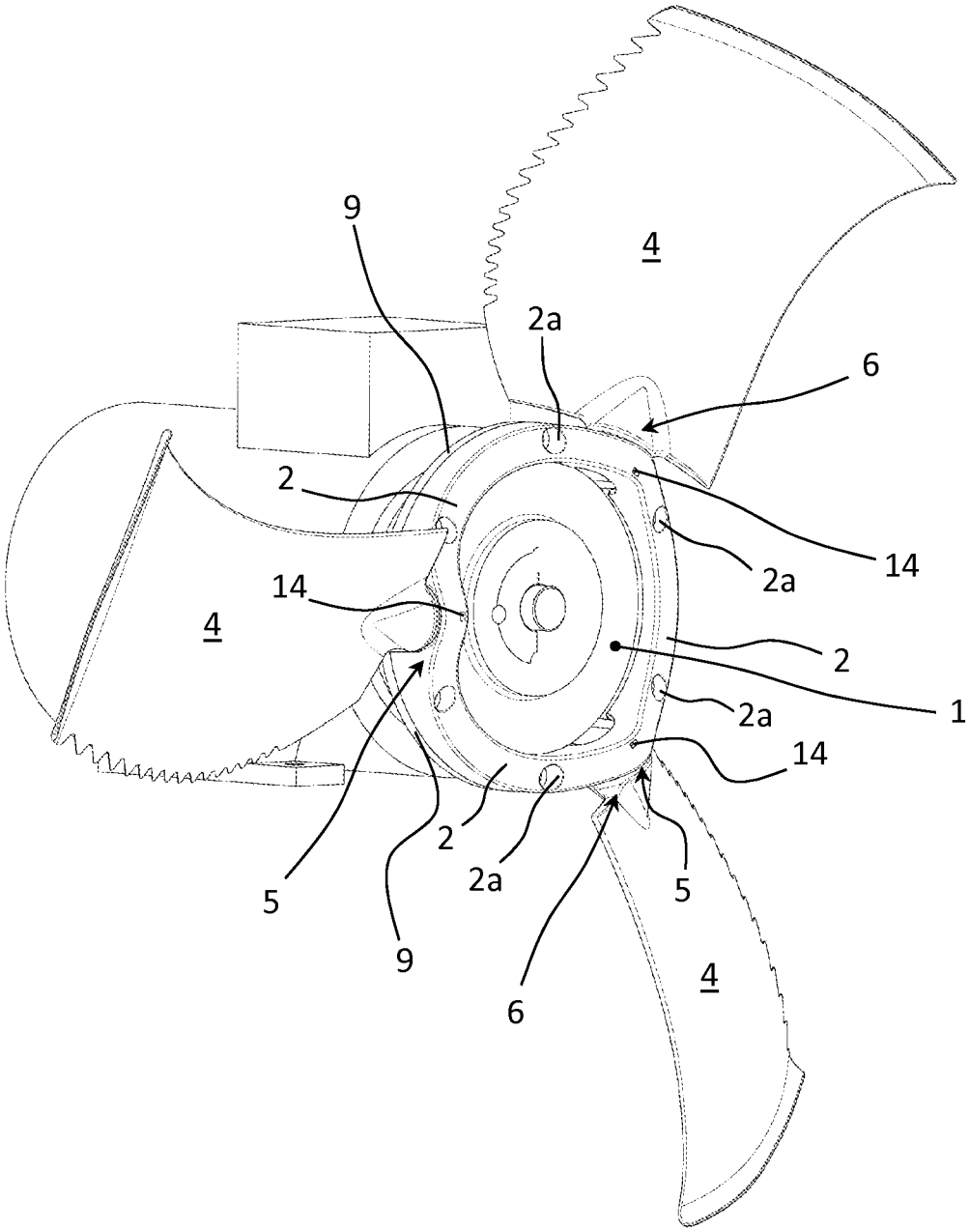
Figure 6:
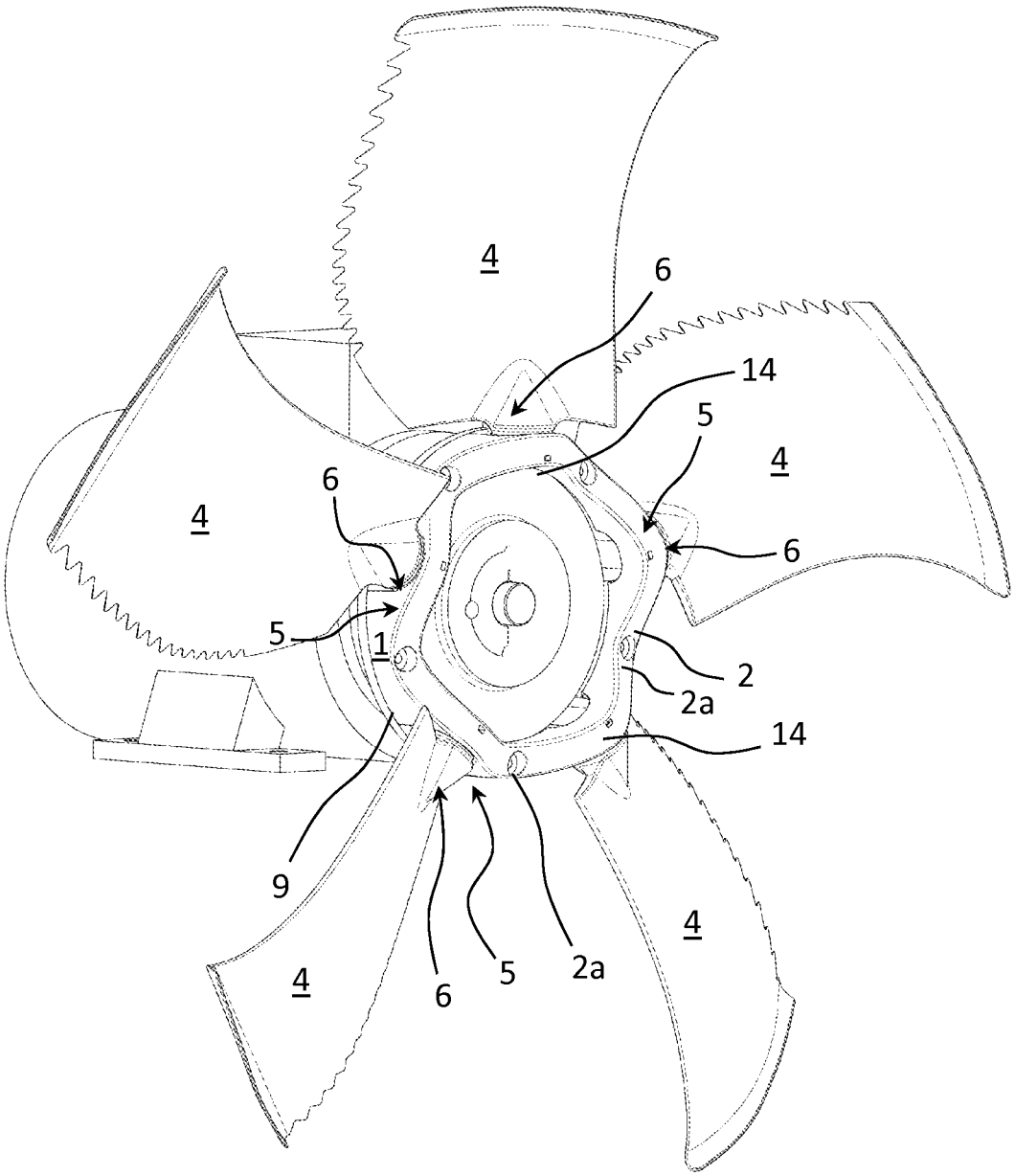
Figure 7:
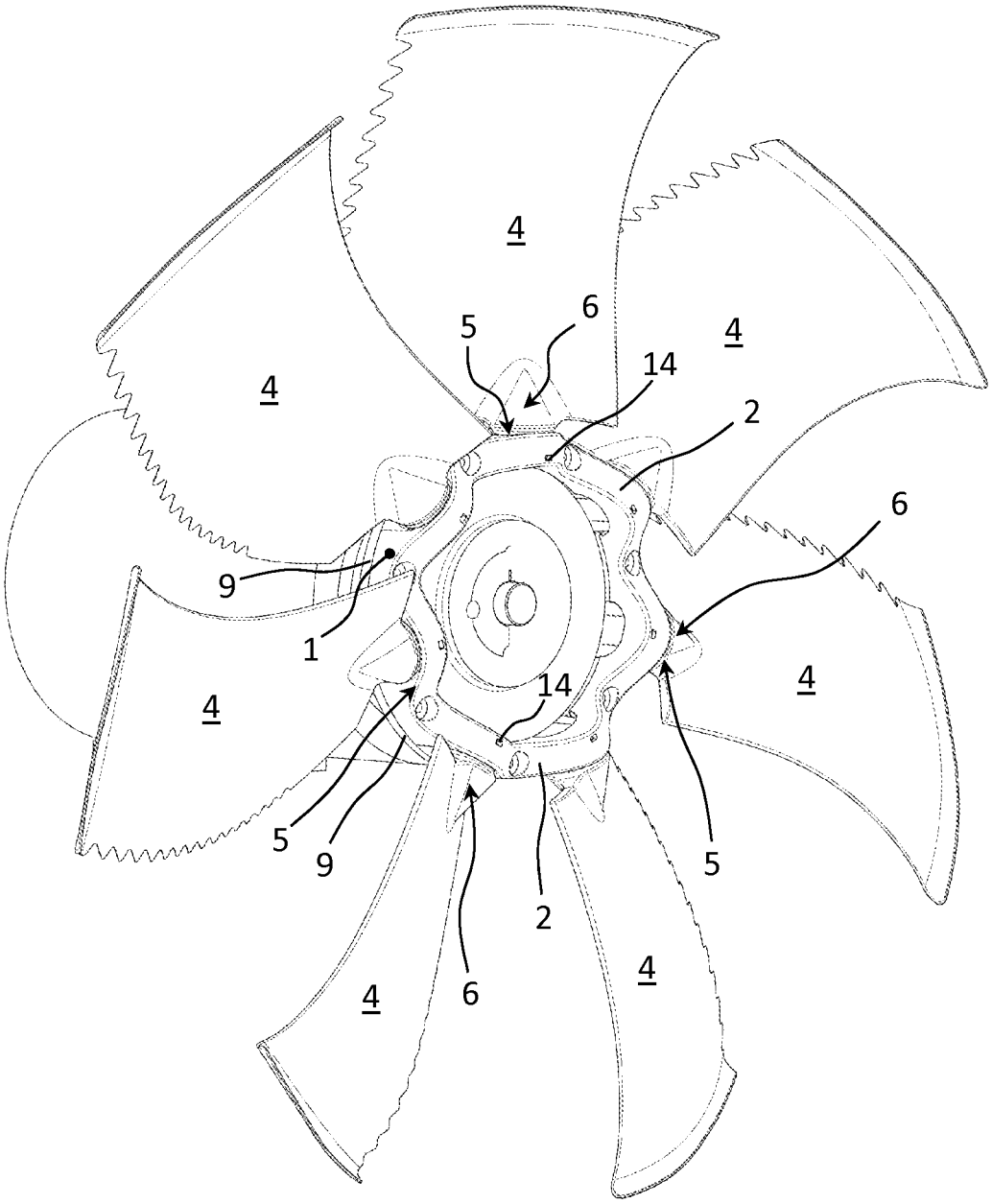
Figure 8:
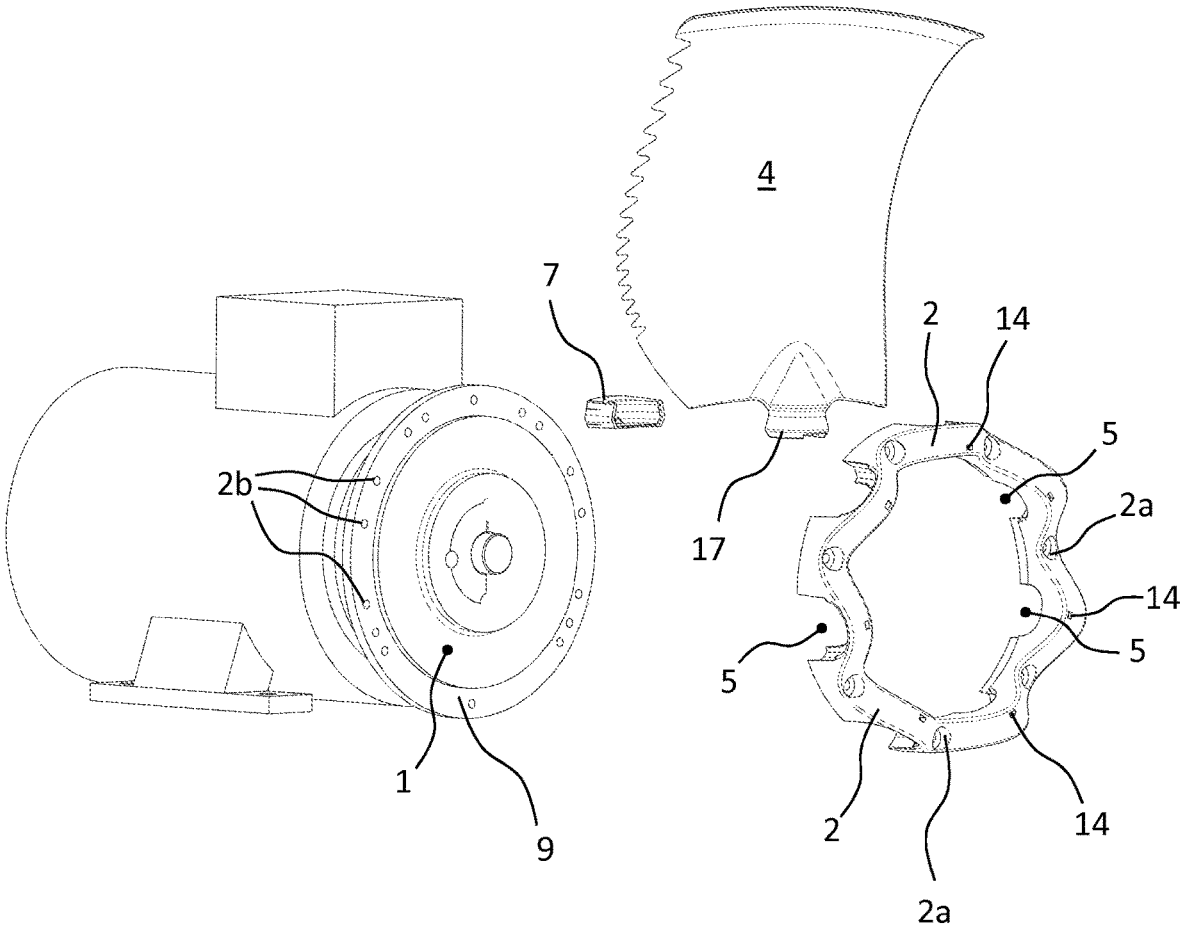
Figure 9:
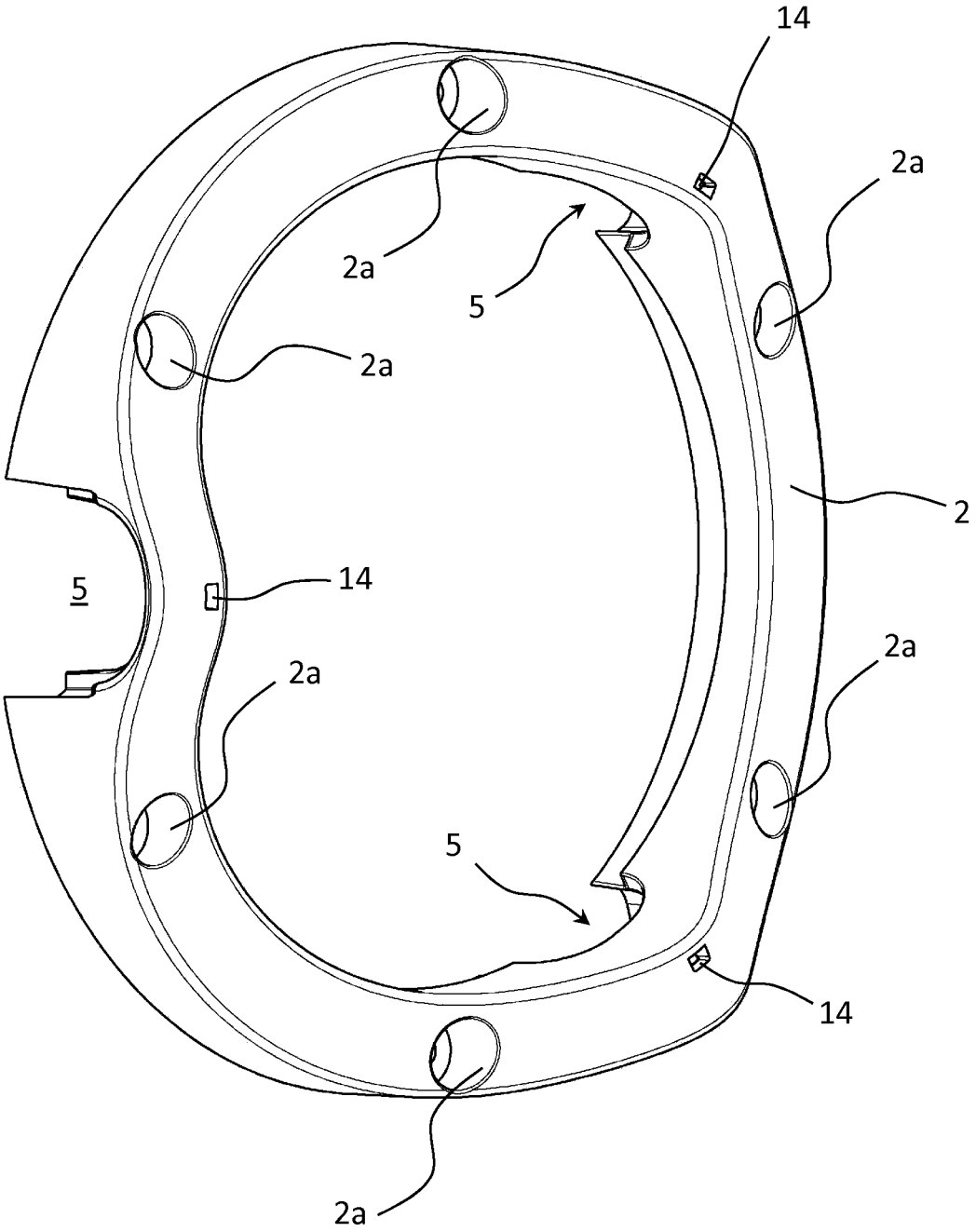
FIG. 9 shows an exemplary embodiment of a tension ring 2 for a total of three blades (not shown), wherein the recesses 5 for receiving one of the respective blades can be seen therein.
Figure 10:
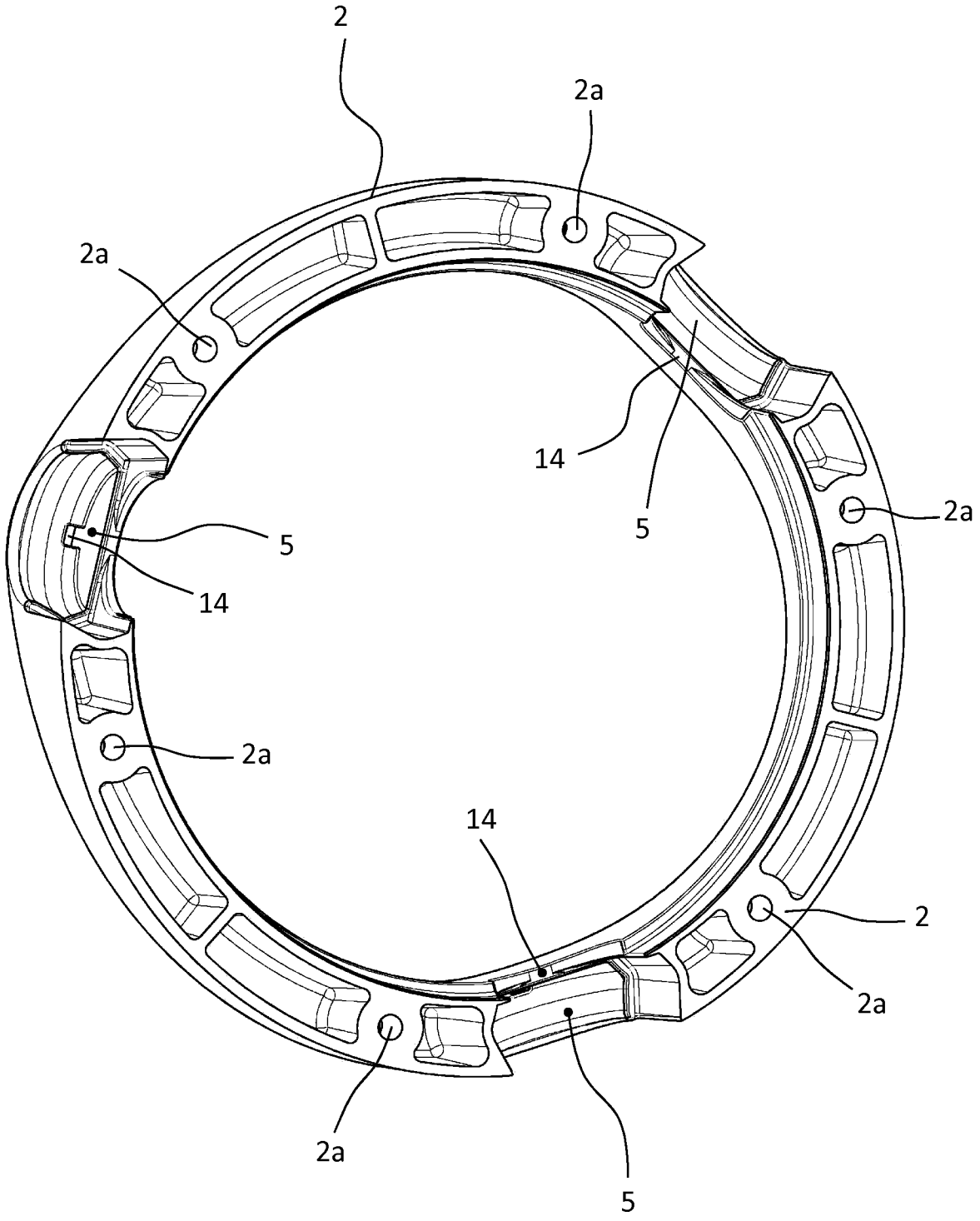
FIG. 10 shows the subject matter of FIG. 9 in a rear view, specifically with a view into the recess 5.
Figure 11:
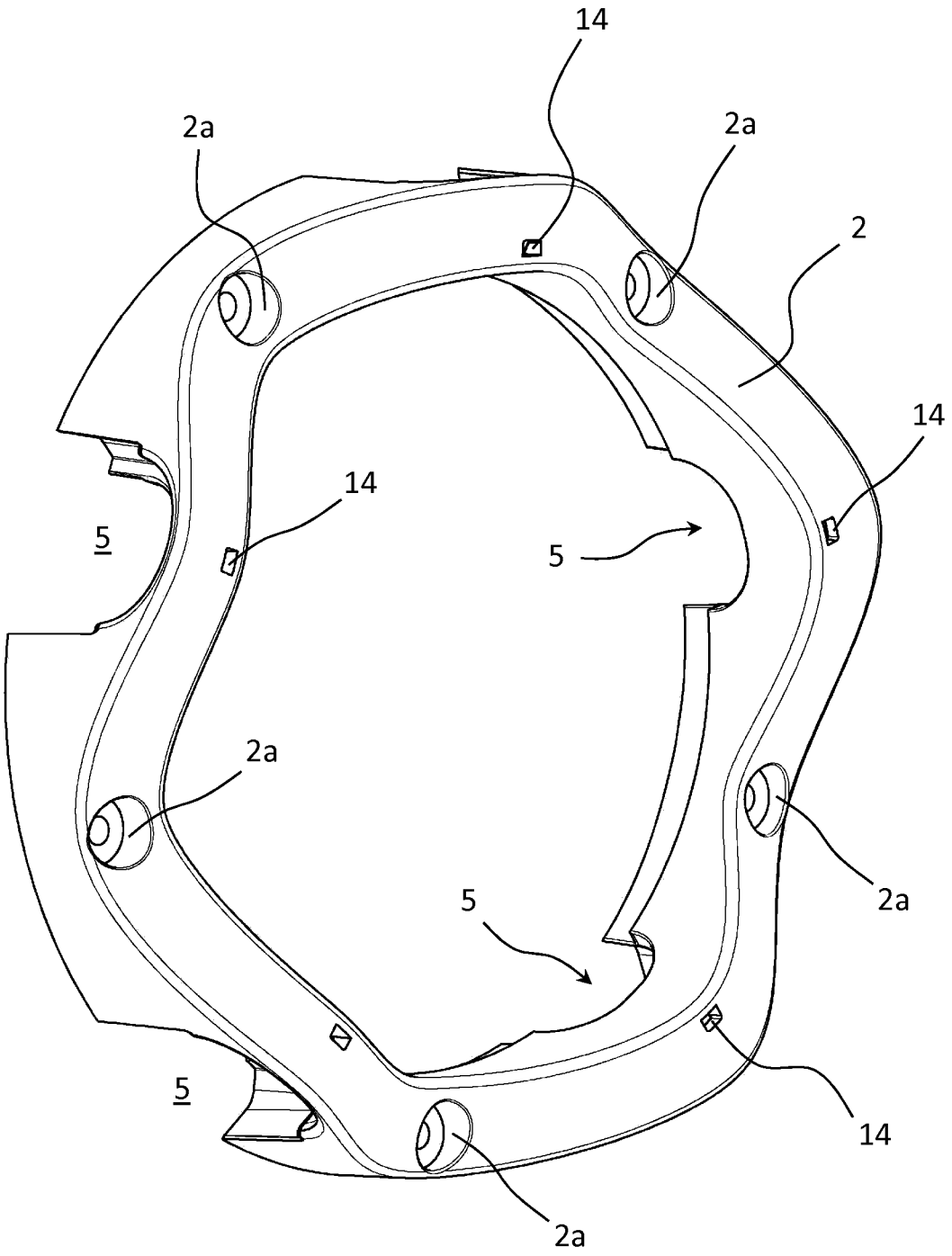
Figure 12:
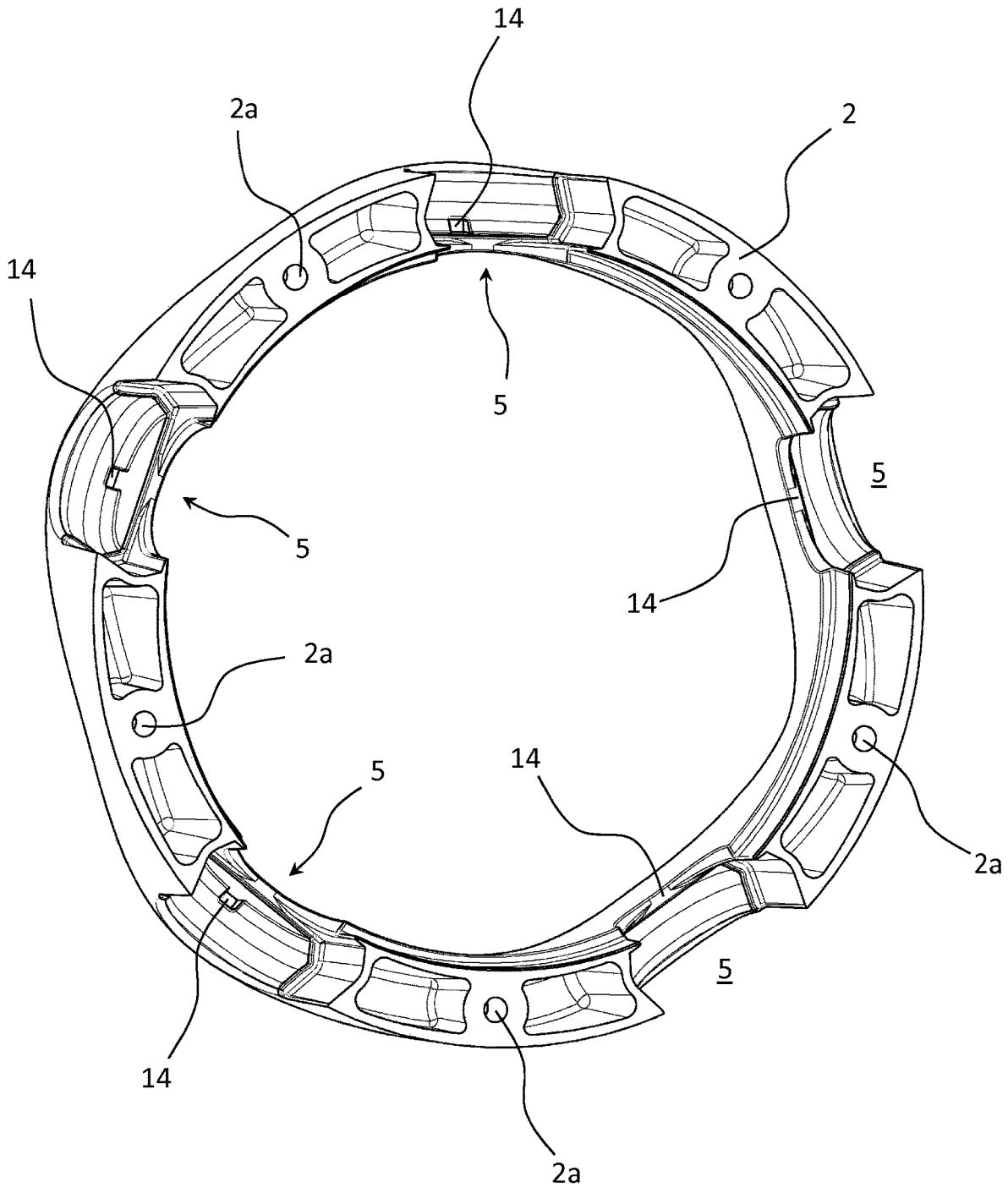
Figure 13:
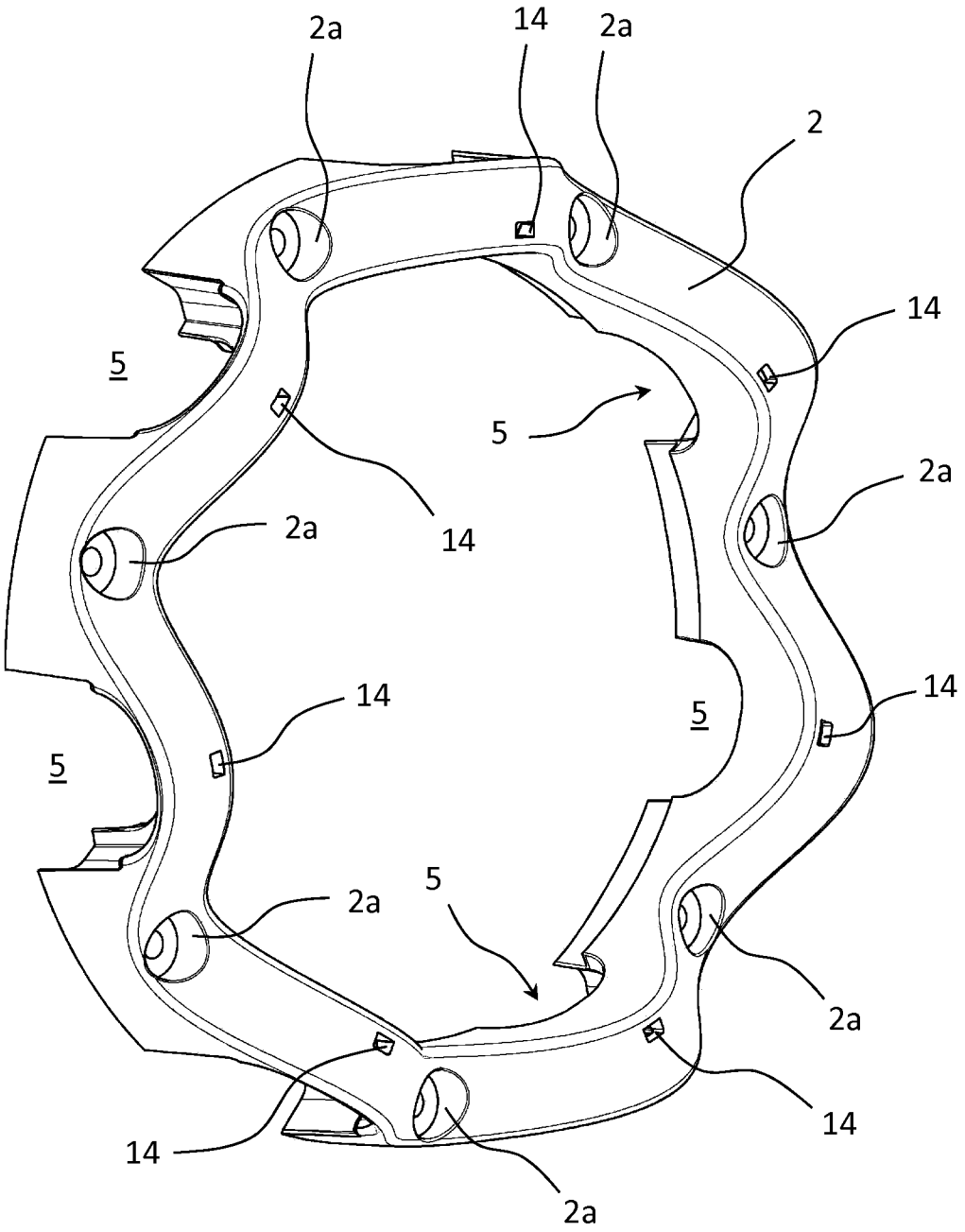
Figure 14:
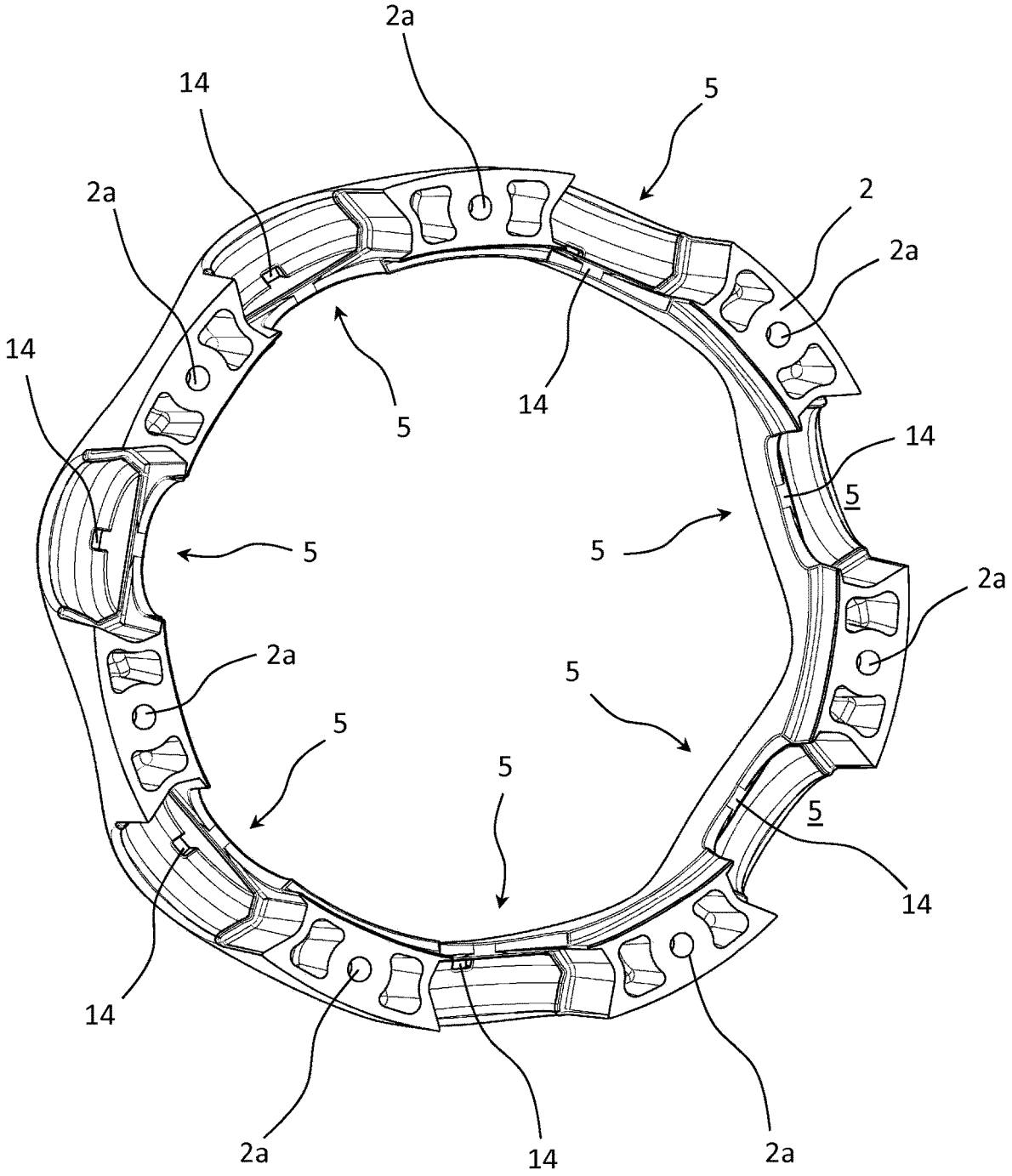

FIGS. 11 and 12, as well as 13 and 14, show further exemplary embodiments of a tension ring 2, specifically for five and seven blades 4, in each case in a view from the front and from the back. The respective recesses 5 can be clearly seen therein.

Figure 15:
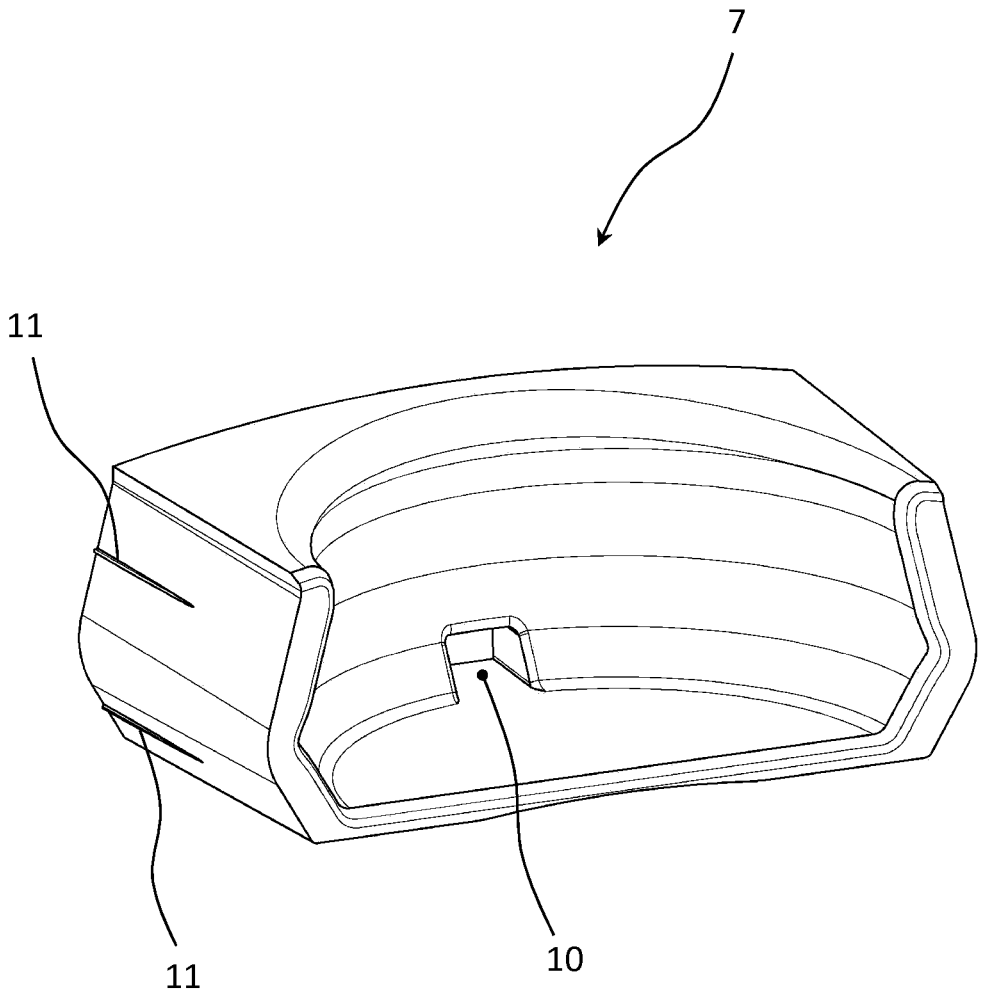

FIG. 15 shows an exemplary embodiment of a retaining piece 7, such as can be used in all of the variations of the tension ring 2 illustrated above in order to form the receiver. The retaining piece 7 is equipped in the interior with a hole 10 into which a positioning lug, not shown in FIG. 15, of an indexing piece can be inserted, which serves to define the blade angle.

It is furthermore indicated in FIG. 15 that the retaining piece 7 is equipped with ribs 11 on the exterior, which serve to lock the retaining piece 7 in place on the tension ring 2, when it has been inserted. Alternatively, instead of the ribs 11, a type of snap-on/latching or similar connection could act between the retaining piece 7 and the tension ring 2, in order to create the aforementioned locking in place.

Figure 16:
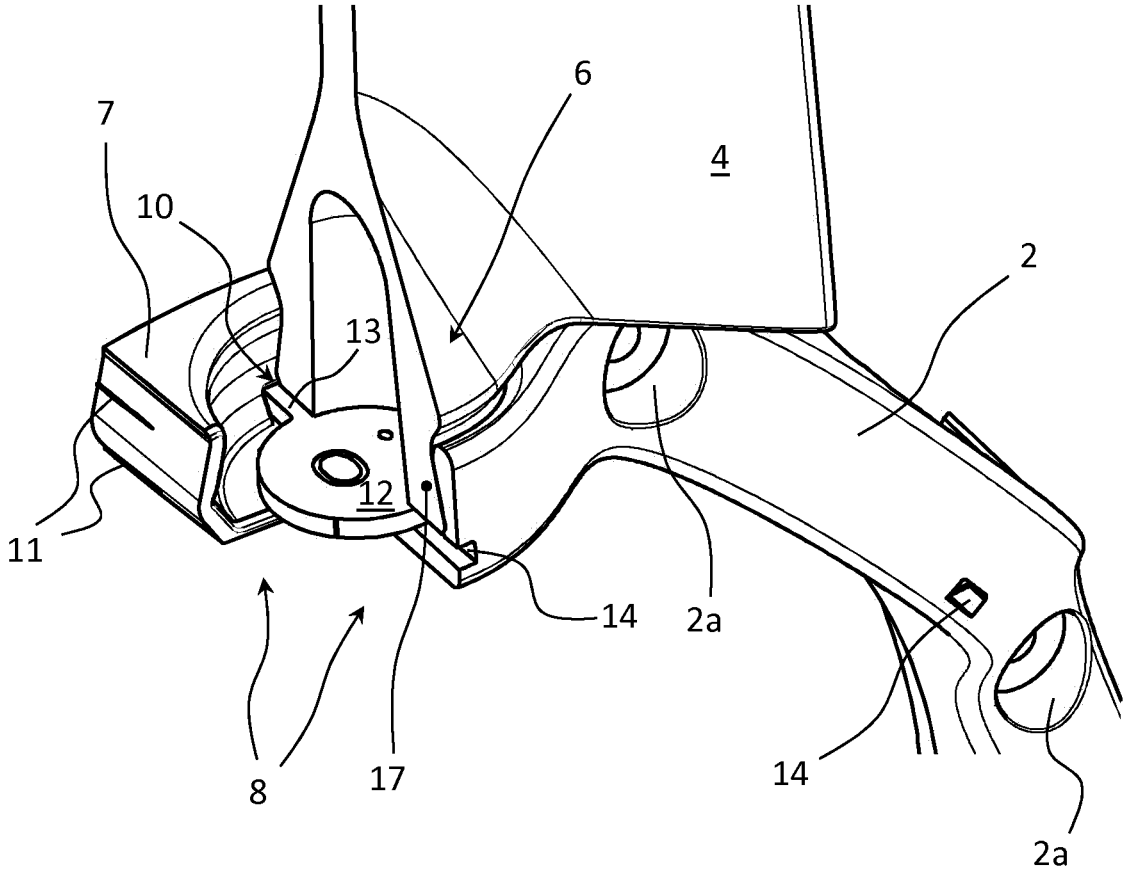

FIG. 16 also shows a passage 14 provided in the tension ring 2, through which the color of the indexing piece 12 can be discerned from outside. The color of the indexing piece 12 corresponds to the angular positions, e.g. +4° and −4°, defined by the indexing piece 12.

Figure 17:
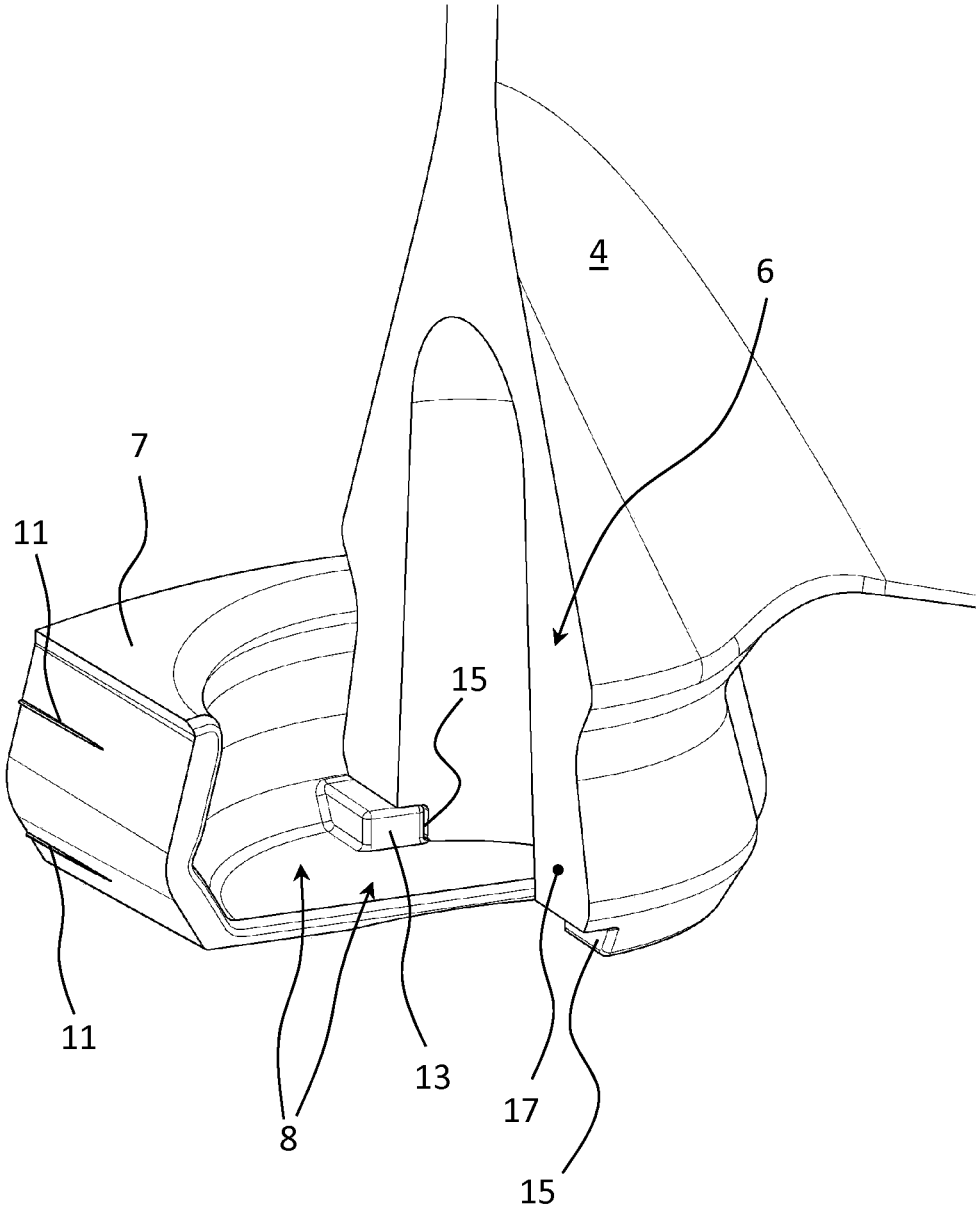

FIG. 17 shows an alternative variation to FIG. 16, for defining the blade angle, in that the retaining piece 7 is equipped therein with a positioning lug 13, which defines a positioning thereof in relation to the bottom of the blade 4, i.e. in relation to the connection region 6 of the blade 4. For this, the connection region 6 of the blade 4 is provided with a recess 16, in which the positioning lug 13 of the retaining piece 7 engages in a locking manner, preferably providing a choice of two different positions.

Figure 18:
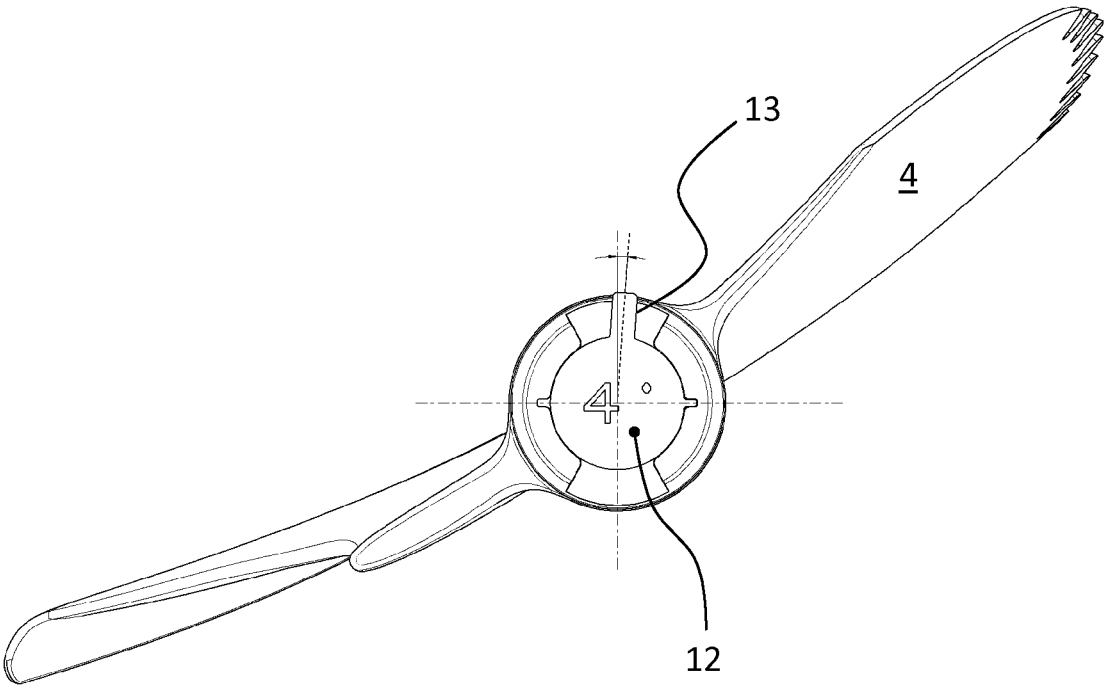
Figure 19:
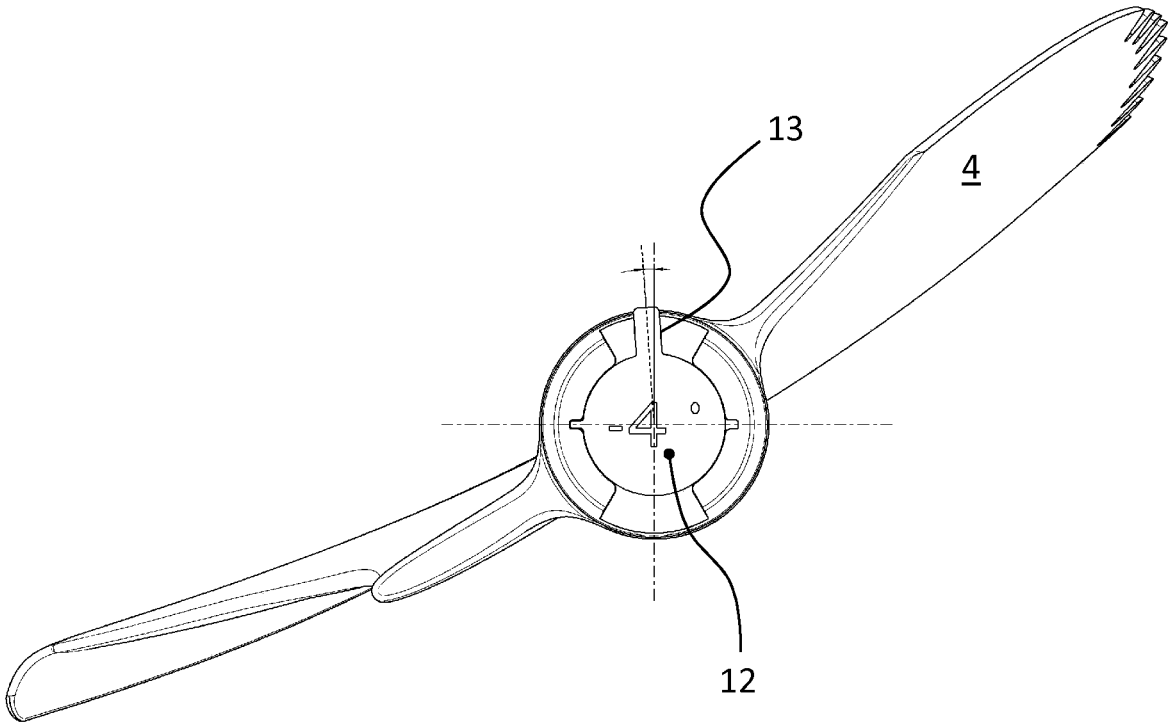

FIGS. 18 and 19 show the blade angle of a blade 4 at +4° (FIG. 18) and −4° (FIG. 19), in each case in the one conveyance direction.

Figure 20:
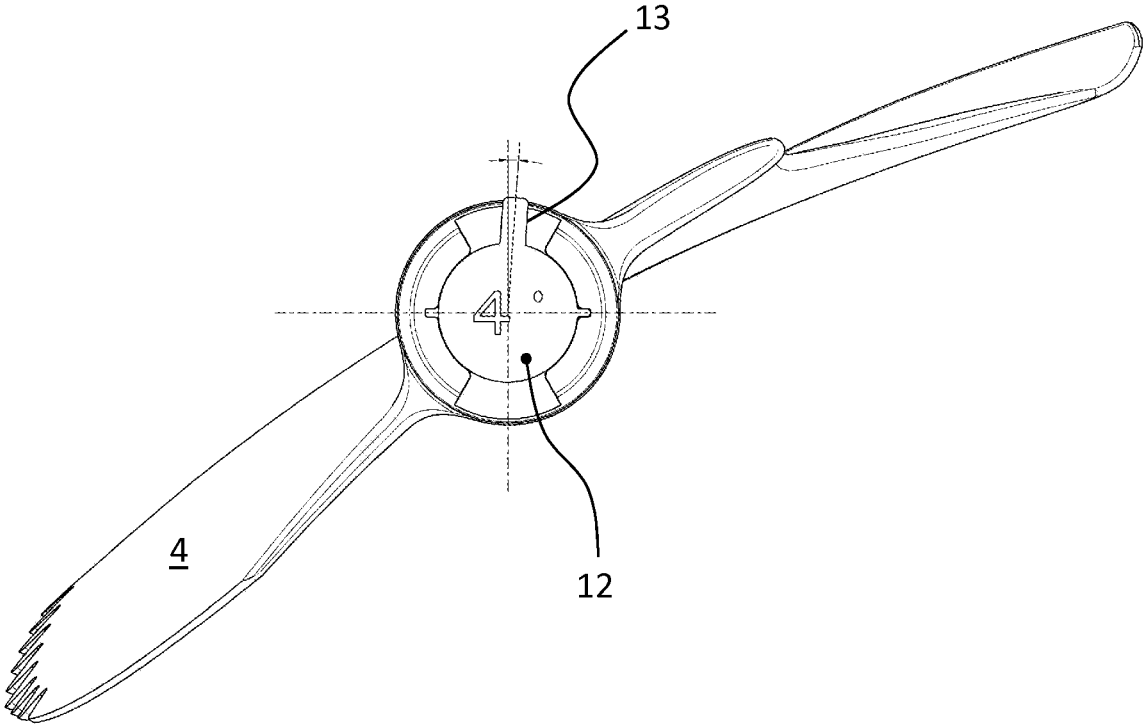
Figure 21:
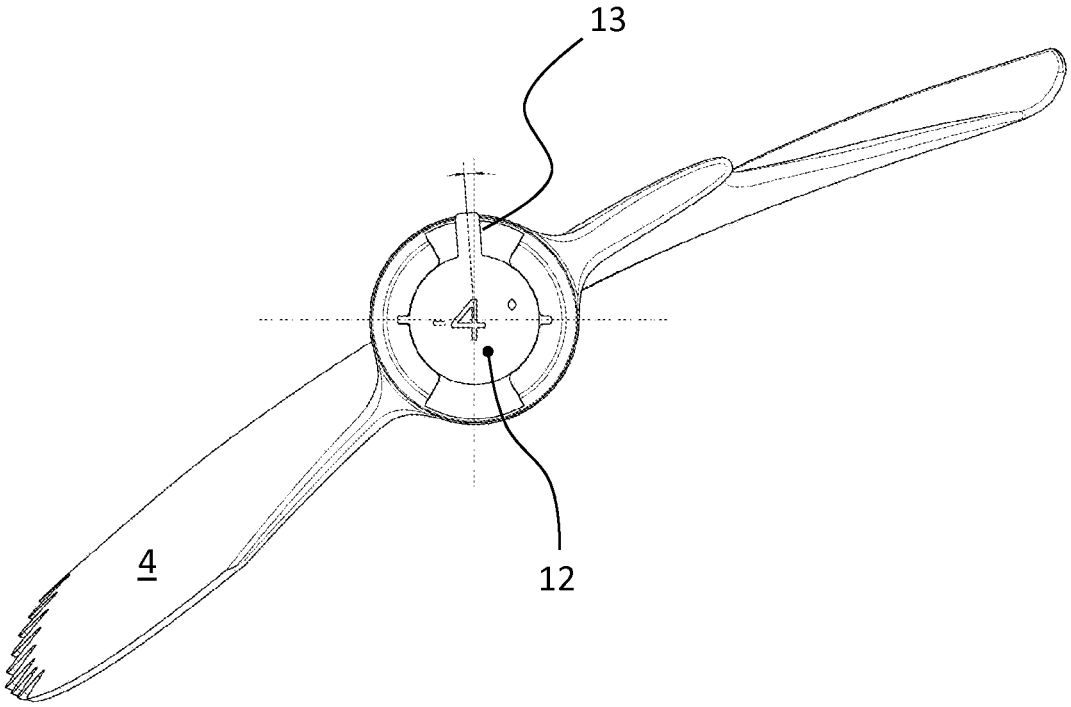

FIGS. 20 and 21 show the blade angle, likewise at +4° (FIG. 20) and −4° (FIG. 21), in each case in the other conveyance direction, i.e. with the indexing piece 12 reversed.

Figure 22:
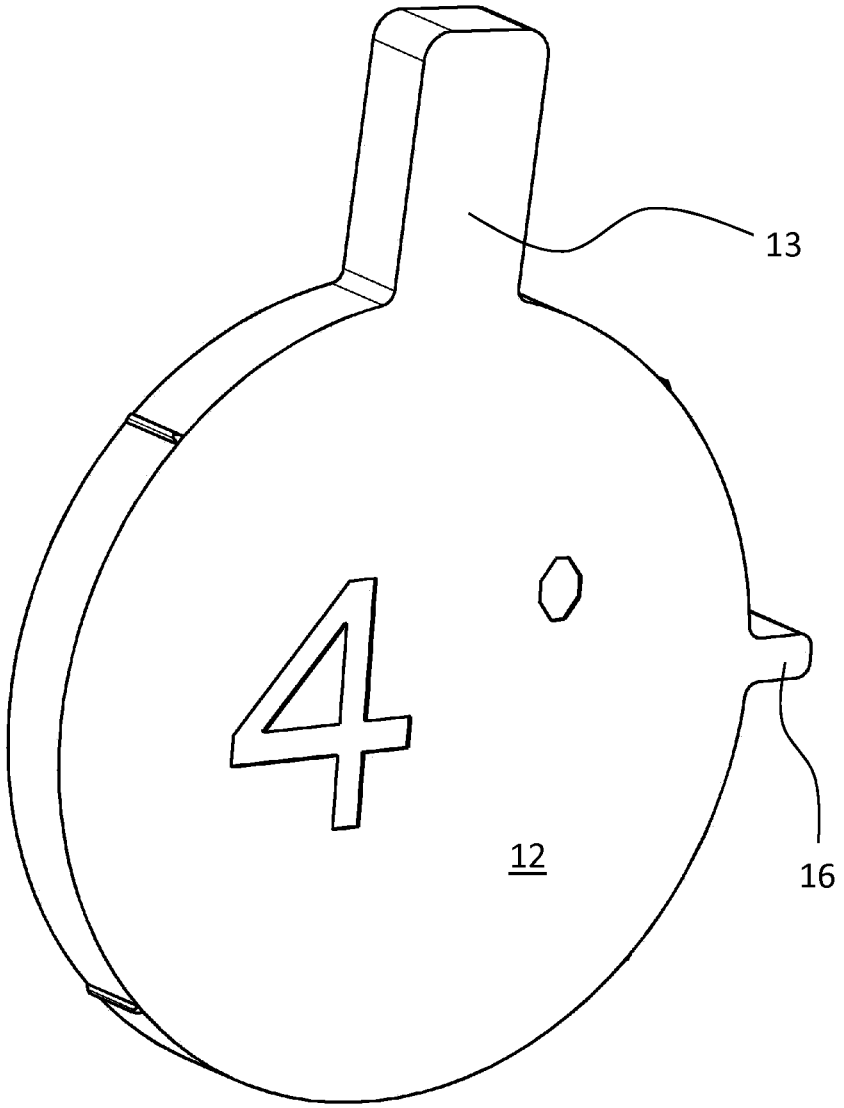
Figure 23:
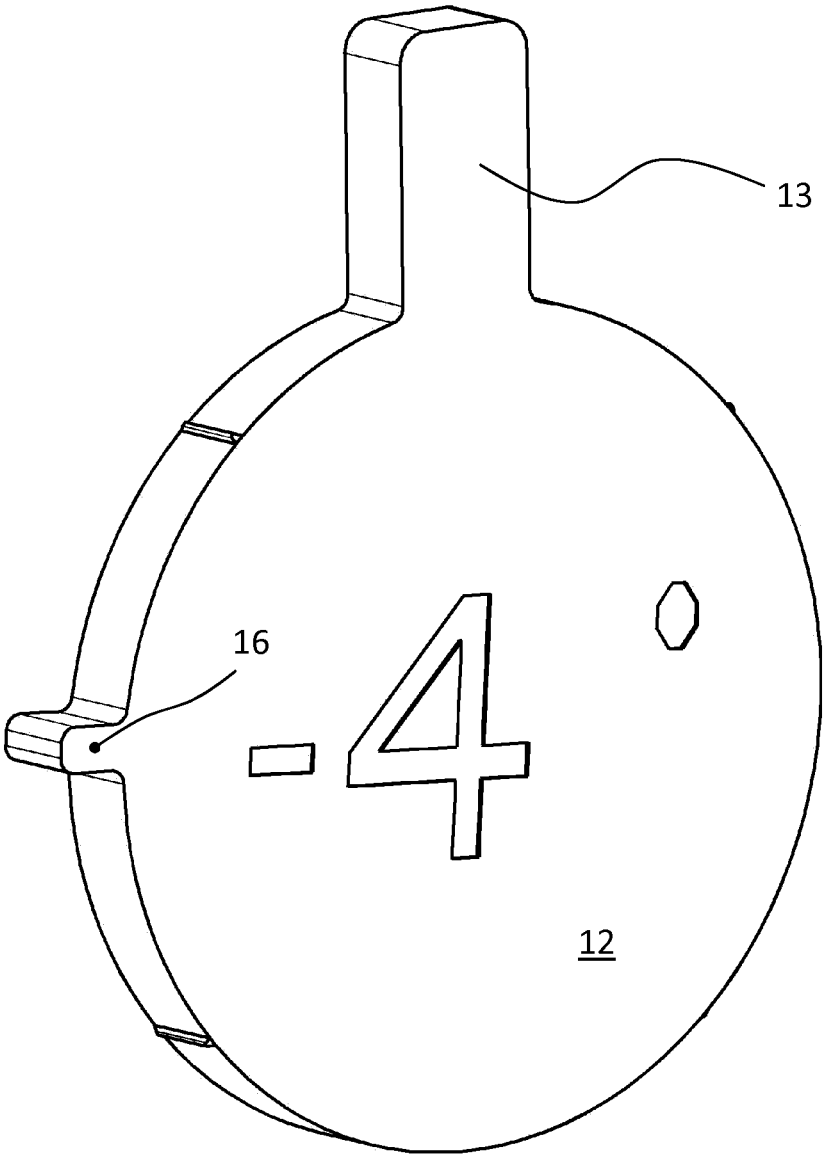

FIGS. 22 and 23 show an exemplary embodiment of an indexing piece 12 with a positioning lug 13 formed thereon, and with an additional locking lug 16.

Figure 24:
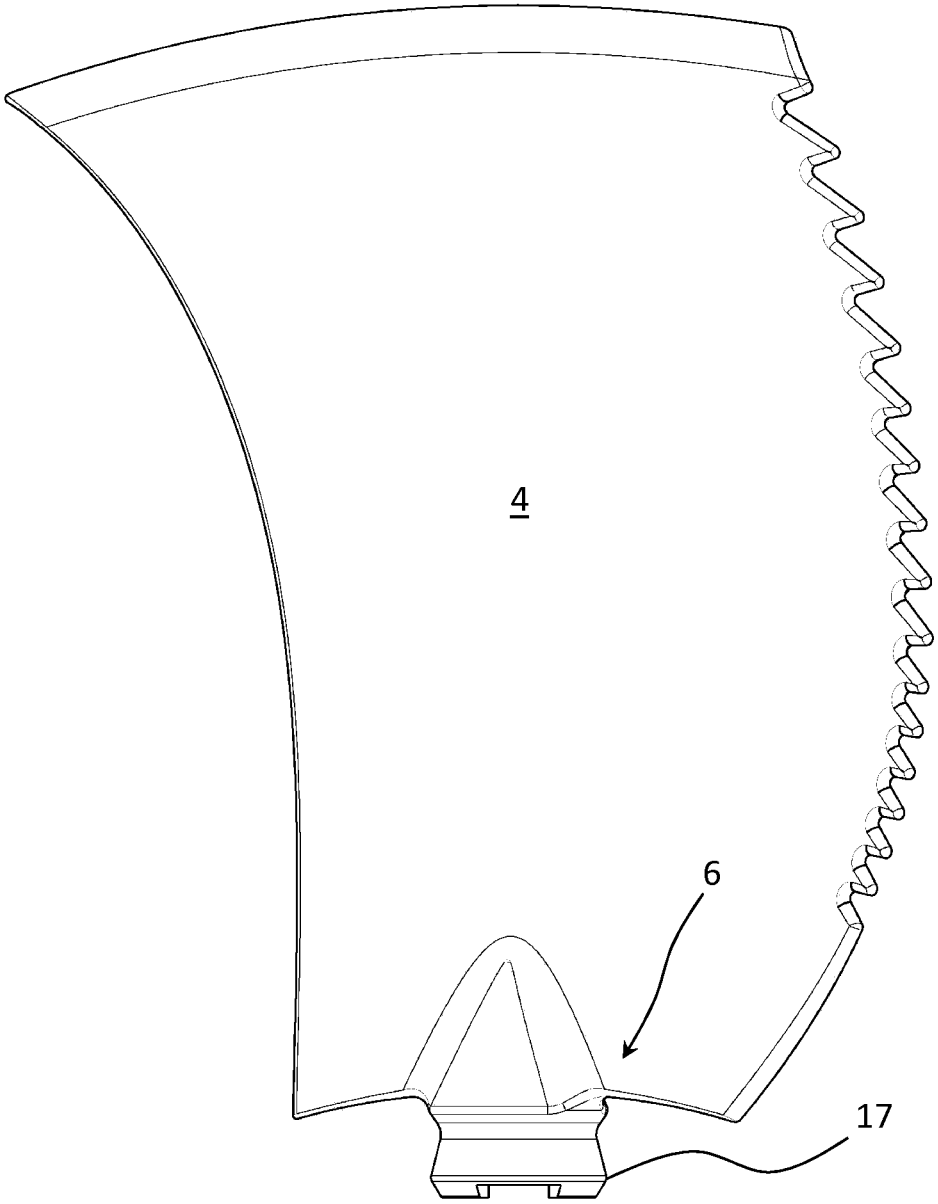

Lastly, FIG. 24 shows an exemplary embodiment of a blade 4, wherein this blade can have different shapes with respect to an aerodynamic design. The substantial aspect of the exemplary embodiment shown in FIG. 24 is that a connection region 6 is provided at the bottom, which, on one hand, serves to receive an indexing piece for setting the blade angle, and on the other hand, has a connecting body 17, which is aligned with the recesses 5 in the tension ring 2 and to the interior of the retaining piece 7, specifically such that it fits precisely in the receiver 8 formed by the tension ring 2 and the retaining piece 7.

With regard to further advantageous designs of the ventilator according to the invention, reference is made to the general portion of the description and to the attached Claims, in order to avoid repetition.

Lastly, it is expressly noted that the exemplary embodiments of the ventilator according to the invention described above serve only as a means for explaining the claimed teachings, but do not limit said teachings to the exemplary embodiments.

LIST OF REFERENCE SYMBOLS

1 rotor
2 tension ring
2*a* passage in tension ring
2*b* hole pattern in flange/hub
3 flange (on rotor)
4 blade
5 recess (in tension ring)
6 connection region (bottom of blade 4)
7 retaining piece
8 receiver (comprised of the tension ring and retaining piece)
9 hub (of the rotor)
10 hole (in the receiver 8, or in the retaining piece)

11 ribs (on retaining piece)
12 indexing piece
13 positioning lug (of the indexing piece/retaining piece)
14 passage (in tension ring)
15 recess (in connection region 6 of the blade 4)
16 locking lug (on indexing piece)
17 connecting body (bottom of blade 4/connection region 6)

The invention claimed is:

1. An axial ventilator having an external or internal rotor motor comprising a rotor, wherein at least two blades having end-side connection regions are connected to the rotor in a form and force fitting manner, and wherein the connection is obtained by tightening the connection regions thereto by means of a tension ring, characterized in that the tension ring has recesses corresponding to the number of blades, which form, together with at least one retaining piece, receivers for the connection regions of the blades, wherein the at least one retaining piece bears on the rotor and the tension ring is connected to the rotor, enclosing the connection regions of the blades, to a flange formed on the rotor or hub, wherein the receiver has at least one hole in the region of the retaining piece and/or in the region of the recess of the tension ring, in which a positioning lug of an indexing piece fits that is non-rotatably dedicated to the connection region of the blade, which is exchangeable and/or reversable, and defines blade angle thereby;

wherein the indexing piece has a specific color corresponding to the blade angle defined by the positioning lug, which is discernable from the outside through a passage formed in the tension ring.

2. The ventilator according to claim 1, wherein the at least one retaining piece comprises a plurality of retaining pieces, characterized in that each of the plurality of retaining pieces are identical, regardless of the number of blades.

3. The ventilator according to claim 1, characterized in that the retaining piece is inserted, at least partially, into the recess of the tension ring, and forms, together with the recess, or the tension ring, respectively, the receiver—for the connection region of the blade.

4. The ventilator according to claim 1, characterized in that the receiver has at least one hole in the region of the retaining piece and/or in the region of the recess of the tension ring, in which a positioning lug of the connection region of the blade fits, and defines the blade angle thereby.

5. The ventilator according to claim 1, characterized in that the indexing piece defines both the conveyance direction as well as the blade angle according to its insertion.

6. The ventilator according to claim 1, characterized in that a positioning lug is dedicated to the retaining piece and/or the recess inside the receiver formed therefrom, which fits in a recess in the connection region of the blade, and defines the blade angle and the conveyance direction thereby.

7. The ventilator according to claim 1, characterized in that the tension ring is screwed to a flange and the hub of the rotor, from the tension ring-side or from the flange-side.

8. The ventilator according to claim 1, characterized in that the blade, the tension ring, a retaining element, and an indexing piece, are made of plastic in an injection molding process, and/or aluminum in a pressure die casting process.

9. The ventilator according to claim 5, characterized in that the indexing piece-defines two conveyance directions and two blade angles through the reversal thereof.

10. The ventilator according to claim 1, characterized in that the tension ring is screwed to the rotor from a front of the tension ring or from a back of the tension ring.

* * * * *